United States Patent [19]

Decaux

[11] 4,210,973

[45] Jul. 8, 1980

[54] SANITARY UNIT

[76] Inventor: Jean-Claude Decaux, 53 Avenue du Marechal Lyautey 75016, Paris, France

[21] Appl. No.: 964,454

[22] Filed: Nov. 29, 1978

[30] Foreign Application Priority Data

Dec. 2, 1977 [FR] France ..... 77 36370

[51] Int. Cl.[2] ..... E03D 11/00

[52] U.S. Cl. ..... 4/420; 4/300; 4/662; 4/479

[58] Field of Search ..... 4/6, 111.2, 1, 420, 4/7, 300

[56] References Cited

U.S. PATENT DOCUMENTS 2,075,830 4/1937 Salvoni ..... 4/6

2,834,026 5/1958 Kronish ..... 4/7

3,919,726 11/1975 Godwin et al. ..... 4/1 X

*Primary Examiner*—Henry K. Artis

*Attorney, Agent, or Firm*—Kenyon & Kenyon

[57] ABSTRACT

The sanitary unit comprises at least one vessel such as a bowl, basin or a lavatory pan and is intended to be installed in particular in cabins of public or private places such as sanitary installations located in towns or areas in the country such as those provided alongside roads. In this unit the vessel is movable between a position of use and a cleaning position. The unit comprises means for cleaning the vessel when the latter is in its cleaning position and means for controlling the displacement of the vessel between the two positions and means for actuating the cleaning means.

13 Claims, 5 Drawing Figures

SANITARY UNIT

The invention relates to a sanitary unit comprising at least one basin bowl or lavatory pan intended to be installed in particular in cabins of public conveniences located either in towns or country areas such as those found alongside roads.

Presently-known sanitary units usually comprise cabins equipped with fixed basins, bowls or lavatory pans the cleanliness of which often leaves much to be desired, since everyone is not always careful to leave the place in as clean a condition as he would like to find it. Further, these regions of convenience tend, as it is known, to be sources of contamination due to dejections and splashing of all kinds which soil them, even if the tap or the flushing means has apparently performed its evacuating function.

An object of the invention is to asceptisize, or at any rate disinfect, these centres of contamination so as to provide for the users sanitary units which are thoroughly washed, brushed and disinfected after each use.

According to the invention, there is provided a sanitary unit comprising a vessel and a discharge pipe for dirty water or dejections, wherein the vessel is mounted to be movable between a first position of use and a cleaning second position, the unit further comprising means for cleaning the vessel when the latter is in the second position, means for controlling the displacement of the vessel between said two positions and means for actuating the cleaning means.

According to a feature of the invention, the sanitary unit also comprises programming means which act on the means controlling the displacement of the vessel and those actuating the cleaning means, said programming means comprising cam discs keyed on a common shaft but angularly spaced apart, each cam pertaining to at least one control means acting respectively on the means for displacing the vessel and the means for actuating the cleaning means, said control means being disposed in the same angular position relative to the discs.

In a preferred embodiment, the vessel consists of two parts, namely a lavatory pan and a separate backrest, each of said 2 parts being mounted on a pivot shaft to be angularly movable and being associated with control means for moving it from a position of use to a withdrawn position for cleaning, the pivoting of the pan and back rest being in opposite directions.

Further features and advantages of the invention will be apparent from the ensuing description of a preferred embodiment which is given merely by way of example and illustrated in the accompanying Figures in which.

Figure 1:
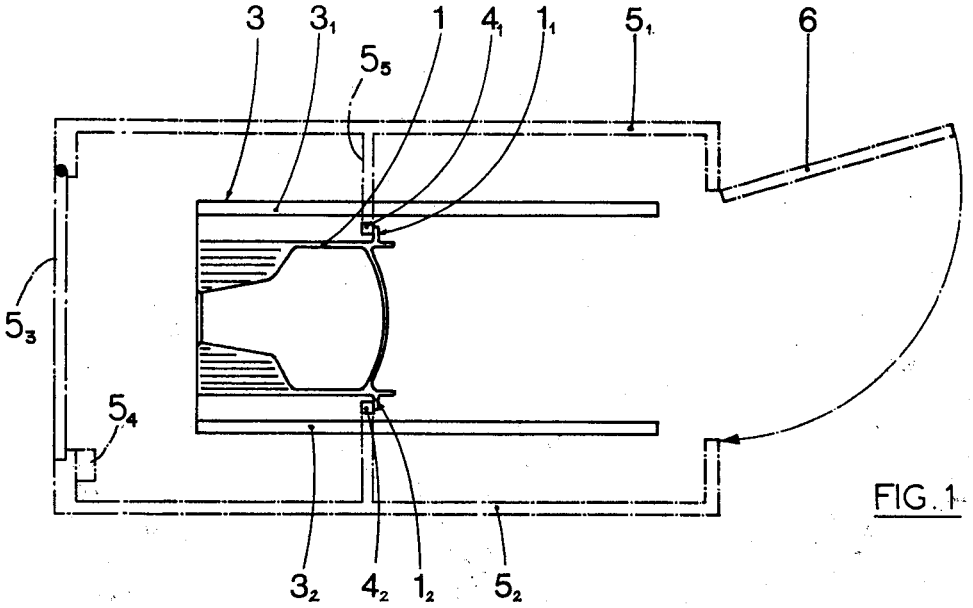
FIG. 1 is a partial top plan view of the sanitary unit.

The expression sanitary unit is intended to encompass here any installation comprising at least one lavatory, cleaning or washing receiving vessel, for example a lavatory pan, bowl, basin or seatless lavatory.

In the considered embodiment, the sanitary unit comprises a receiving vessel or pan 1, extended by an independent backrest 2, this pan being in a form of a seatless lavatory and being supported by a frame 3 comprising two girders $3_1$, $3_2$ and posts $4_1$, $4_2$ against which the pan 1 is immobilized in the position of use. As can be seen in the drawings, the vessel or pan 1 has a closed bottom, i.e no outlet is provided for the matter received by the vessel.

This immobilization is achieved by means of flanges $1_1$, $1_2$ which are rigid with the pan and abut the rear face of the posts $4_1$, $4_2$. This frame is located within a cabin defined by walls $5_1$, $5_2$ which are closed in the front by a door $5_3$ provided with a locking device $5_4$ which may or may not be associated with a slot machine for actuating it, the rear part of this cabin being closed by a door 6 for the servicing of the cleaning part located at the rear of the sanitary unit. Wall means $5_5$ are provided for partitioning the rear cleaning part of the cabin off from the front part which receives the user of the unit. The backrest 2 and a portion of the pan or vessel 1 form a withdrawable part of the wall means.

The main principle of the invention resides in the fact that the vessel (which may be, as mentioned before, formed by a plurality of pans or a plurality of aligned bowls or basins) is mounted to be movable between a position of use (in which the backrest is substantially vertical) and a cleaning position which may correspond either to a rearward/swinging of the vessel as is the presently-described case, or a withdrawal of the vessel for example a downward withdrawal or on the contrary a lateral withdrawal if the cleaning means are located on the side of the sanitary unit.

In the presently-described embodiment, the vessel is mounted to be withdrawn by a rearward swinging thereof and the pan 1 is independant of the backrest 2. The cleaning means comprise a rotary brush 7 which is mounted to be movable between a position of use in which the cleaning means are operative, and a raised position shown in dot-dash lines at $7_1$ for reasons which will be mentioned hereinafter.

This brush is rotatively mounted on a shaft 8 and is angularly movably mounted on two side arms 9, which are pivotally mounted on pins 10, these arms having an angular travel which corresponds to the two positions of the brush.

The brush is driven in rotation by a reversible motor-speed reducer unit 11 so as to be capable of rotating periodically in one direction and then the other, as will be explained in the descriptions of FIG. 4 and 5.

The brush is disposed in an enclosure such as a circular drum 12 which is open at least in its upper part and has a base which is connected to drain means such as a spout 13 extended by a trap or stench trap 14, the spout and the trap being protected by a grate 15 consisting of parallel members oriented in the direction of displacement of the bristles of the rotating brush, these members retaining hard objects which might stop up the trap. This grate is of concave shape and has a step $15_1$ which defines with the inner wall of the drum 12 a recess 16 into which fall, under the effect of gravity, the objects which cannot be discharged and are centrifugated by the action of the brush. These objects may be thereafter recovered by merely swinging over or withdrawing the front part of the drum which is, in any case, necessary for raising the brush.

Figure 2:
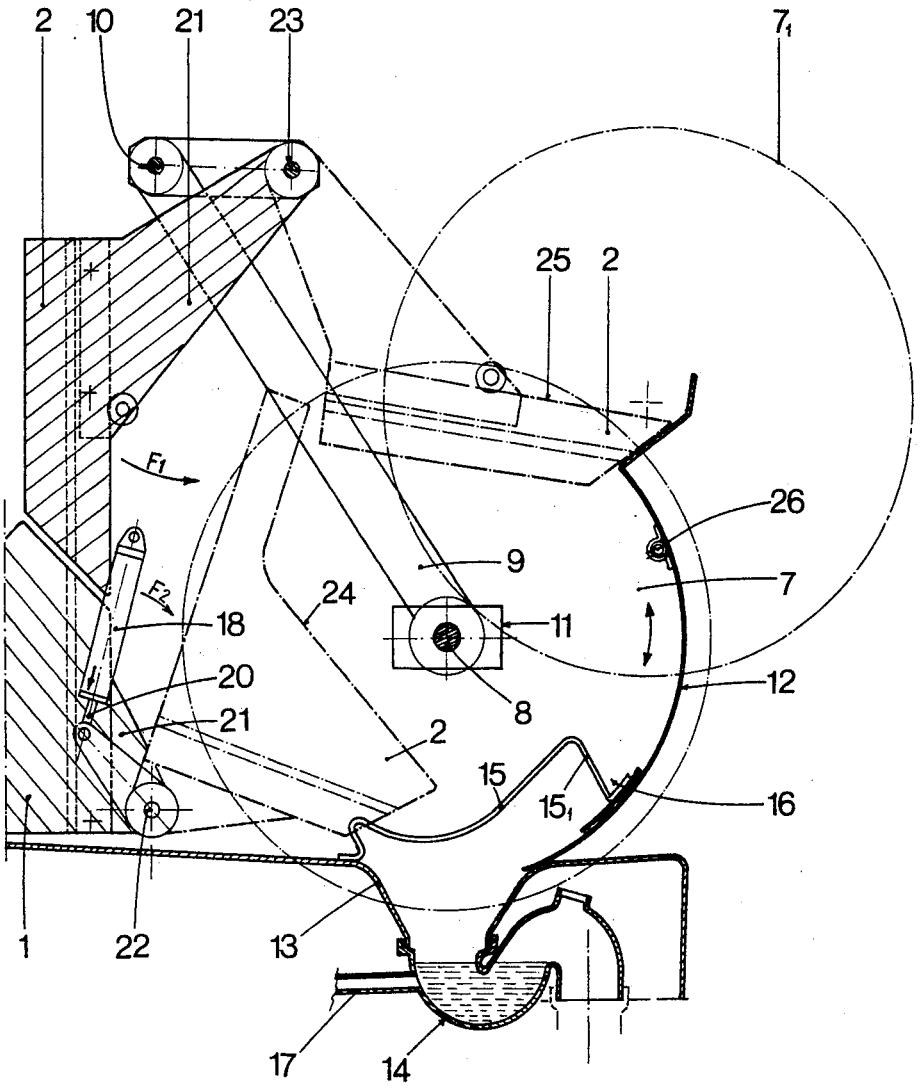
FIG. 2 is a sectional view of the cleaning part of the sanitary unit.

The trap is provided as shown in FIG. 2 with a pressurized water supply pipe 17 which ejects by a jet of water substances which might have accumalated in the elbow of the trap.

The means for shifting or swinging the pan and backrest comprises two jacks 18(FIG. 2) and 19(FIG. 3), the rod 20 of these jacks being connected to wings or flanges 21 which are respectively rigid with the pan and backrest. These flanges may be moulded in one piece with the pan or backrest if these elements are moulded from metal or plastics material.

Figure 3:
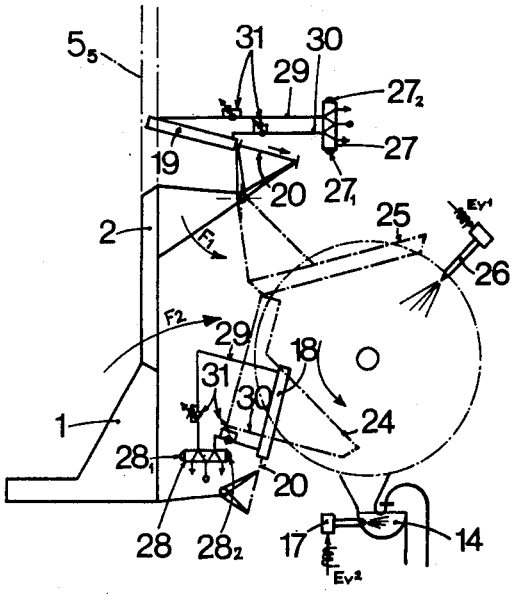
FIG. 3 is a diagrammatic view of the means for controlling the swinging of the pan and backrest.

As can be seen in FIGS. 2 and 3, the pan 1 pivots on a shaft 22 under the action of the jack 18 and the backrest 2 pivots on the shaft 23 under the action of the jack 19. The retraction of the jack 18 corresponds to the swung-over position of the pan shown in dot-dash lines at 24 and the retraction of the jack 20 corresponds to the swung-over position of the backrest shown in dot-dash lines at 25 (FIG. 2). It can be seen in FIG. 2 that the pan and the backrest swing in opposite directions as indicated by arrows $F_1$ and $F_2$. In the swung-over position, the pan faces the rotary brush 7 and the backrest 2 closes the upper part of the drum 12 so as to avoid projection of water out of the drum. Further, the drum has a water supply system 26 provided with a row of radial perforations extending throughout the generatrix of the brush so as to spray the latter and complete the cleaning. The water supplied by this system may be pure water or water to which an antibacteria or antimicrobe disinfecting solution has been added.

Figure 4:
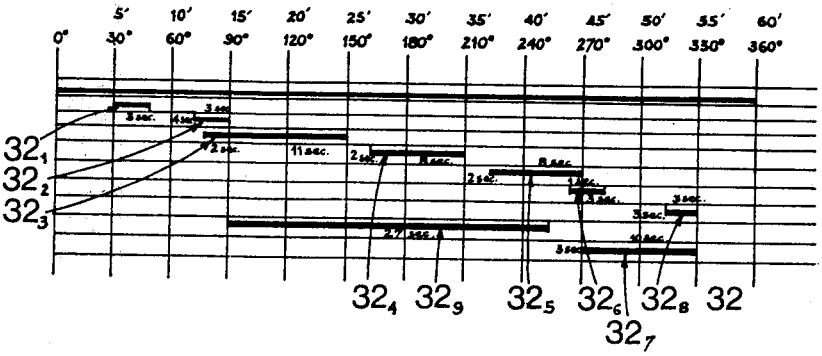
FIG. 4 is a diagram showing an operational cycle which is developed and concerns the active parts of the cams of the rotary discs.
Figure 5:
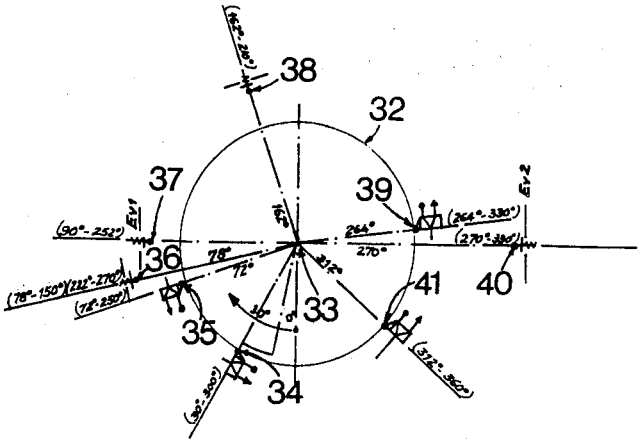
FIG. 5 is a diagrammatic view of a cycle of operation of the programming means.

The means for controlling the swinging of the pan and backrest (jacks 18 and 19) and the means for driving the cleaning means (reversible motor 11), and the means for actuating the water supply system 26 and for bringing into action the supply 17 of water under pressure for the trap are programmed by a system of rotary cam discs such as that shown in FIGS. 3 to 5.

As shown in FIG. 3, the jacks 18 and 19 which are made from fibre glass reinforced resin and actuated by water from a source of water under pressure (not shown), are respectively controlled by directional valve devices 27 and 28 having slide valve members and connected by pipes 29 and 30 to the two ends of the jack 19 and 20. These pipes are provided with flow limiters 31 comprising a calibrated orifice and a check-valve connected in parallel. These directional valve devices 27, 28 enable either end of the jacks 18 and 19 to be selectively supplied with water so as to extend or retract the pistons 20 of the two jacks.

The water supply system 26 (FIG. 2) is controlled by an electrically-operated valve $EV_1$ and the jet pipe 17 of the trap is controlled by an electrically-operated valve $EV_2$.

The programming means (FIG. 5) comprise, as mentioned before, a series of discs 32 which are keyed on a common shaft 33, these discs being rotary discs and each comprising a cam of identical contour or profile but of different lengths. The various discs are angularly offset so that each cam encounters in succession a control means acting respectively on the swinging jacks, the reversible motor of the brush, the water supply system 26 or the jet pipe 17 for the trap. All the control means are disposed in a common angular position relative to the discs so as to be individually swept through by the disc associated therewith.

The control means comprise switches and sensors, as shown in FIG. 5. In order to explain more clearly the cycle of operation, FIG. 5 shows a single disc 32 on the periphery of which are disposed, at selected angles, the control means (switches and sensors) which act on the means for controlling the swinging, on the means for actuating the brush and the means for bringing into action the water supply system and the trap jet pipe 17.

With reference to FIG. 4, it will be seen that the point 0 corresponds to the departure of the user from the sanitary unit and consequently to the closure of the door $5_3$ which starts up the rotation of the rotary discs 32 until the first cam $32_1$ encounters, after an angular displacement of 30°, the sensor 34 which is connected to the end $27_1$ of the moving part of the directional valve device 27. The sensor 34 is actuated for three seconds which correspond to the swinging over of the backrest 2 which closes the drum. After a pause of four seconds, the cam $32_2$ encounters at 72° the sensor 35 connected to the end $28_1$ of the moving part of the directional valve device 28 which corresponds to the swinging over of the pan during a period of three seconds. Simultaneously with the swinging over of the pan, at 78°, the cam $32_3$ came into contact with a switch 36 which brings into action the motor 11 driving the brush 7.

This rotation lasts thirteen seconds, this period being determined by the profile of the cam $32_3$ which extends angularly 72°.

Simultaneously with the rotation of the brush, another cam (not shown in FIG. 4) sweeps across a switch 37 controlling the actuation of the electrically-operated valve $EV_1$ associated with the water supply system 26 (FIG. 3).

As mentioned before, the brush rotates in a first direction of rotation (from 78° to 150°) and then, after a pause of two seconds, the cam $32_4$ actuates a switch 38 which starts up the motor 11 of the brush but in the opposite direction to the preceding direction, this rotation lasting eight seconds: at 210°, the brush stops rotating then, after a pause of two seconds, rotates again but in the opposite direction under the action of the cam $32_5$ for a further normal period of rotation of eight seconds. Before the stopping of the brush, the cam $32_6$ encounters another switch 39 connected to the end $28_2$ of the moving part of the distributor valve device 38 which corresponds to the return of the pan to its normal position (of utilization). Upon the swinging of the pan to its normal position, cam $32_7$ encounters a switch 40 which brings into action the electrically-operated valve $EV_2$ controlling the jet pipe 17 for the trap. This action of the jet lasts about two seconds as can be seen in FIG. 4. Simultaneously, another cam $32_8$ acts on a sensor 41 connected to the end $27_2$ of the moving part of the distributor valve device 27 which corresponds to the return of the backrest to the normal position (jack extended).

The cam $32_9$ (FIG. 4), which has an angular extent of about 165° and controls the spraying of the brush by acting on the electrically-operated valve $EV_1$, remains in contact with the switch 37 for twenty-seven seconds.

This programming system has for effect to control the various mechanical, electric or hydraulic means of the unit during the required periodicity. The control discs are driven by a motor-speed reducer unit (not shown) and are keyed on the output shaft of this motor so as to rotate of course at the same speed. However, it is also possible to envisage an arrangement in which the cams of the discs are not angularly offset and it is the control means (switches and sensors) which are arranged in angularly spaced relation on the periphery of the discs (FIG. 5).

This sanitary unit is in particular intended to be provided in public places or in specially arranged zones located alongside roads and in particular in rest areas alongside highways.

The essential advantage of this sanitary unit resides in the fact that the unit for public use is always clean and disinfected, this operation occurring after the user has left the unit and being carried out in an enclosure, i.e. within the drum 12 which is located in a part closed off from the sanitary unit (see partition wall means $5_5$ in FIGS. 1 and 3) so that there is no soiling of the part of the unit that the user enters.

The periodic servicing of the unit is, for example, carried out once a week by a person who operates the described system and then enters the unit by way of the rear door 6, stops the electric and hydraulic supplies, raises the brush 7 to position $7_1$ as shown in FIG. 2 by raising the arms 9 which carry the shaft 8 of this brush and the drum 12. This raising indeed permits the inspection and possible cleaning of the recess 16 and then, after removal of the grate 15, the cleaning of the spout 13 and trap 14.

It must be understood that the scope of the invention is not intended to be limited to the embodiment described hereinbefore for which other control means and other programming means may be provided without departing from the scope of the invention defined in the claims.

I claim:

1. A sanitary unit comprising wall means dividing the unit into a first part for receiving a user of the unit and a second part, a water-closer receiving vessel mounted to be movable between a first position of use in said first part and a vessel emptying and cleaning second position in said second part, the vessel having a closed bottom so as to be outlet-less and thereby retain matter received therein in said first position, said wall means including withdrawable wall means to allow movement of the vessel between said first and second positions, cleaning means located in said second part for cleaning the vessel in said second position, drain means located in said second part for receiving the matter removed from the vessel, shifting means combined with the vessel for shifting the vessel between said first position and second positions, actuating means combined with the cleaning means for actuating the cleaning means, and means associating operation of the actuating means with operation of the shifting means for actuation of the cleaning means when the vessel is in said second position.

2. A sanitary unit as claimed in claim 1, wherein the vessel comprises two parts, namely a closed-bottom lavatory pan and a separate backrest, each of said two parts being mounted to be angularly movable about an axis, said shifting means being associated with each of said parts for moving each of the parts between a first position of use in said first part of the unit and a second withdrawn cleaning position in said second part of the unit, the pan and the backrest moving in opposite directions.

3. A sanitary unit as claimed in claim 1, wherein said means associating operation of the actuating means with operation of the shifting means comprise programming means which comprise a rotary shaft and rotary cam discs keyed on said shaft in positions angularly offset from each other, at least two of said cam discs respectively pertaining to said actuating means and shifting means, and control means for said actuating means and shifting means being disposed at the same angular position relative to the disc for actuation by the discs.

4. A sanitary unit as claimed in claim 3, wherein the means for actuating the cleaning means comprise a reversible motor, and said shifting means comprise jacks.

5. A sanitary unit as claimed in claim 4, wherein the motor is an electric motor and the control means for the actuating means comprise a switchcontrolling the motor and associated with, to be actuated by, the corresponding cam disc and the shifting mdans comprise fluid actuated jack means connected to the vessel, a fluid circuit comprising directional valve means connected to the jack means and sensor means controllingly connected to the directional valve means and associated with for actuation by the corresponding cam disc.

6. A sanitary unit as claimed in claim 1, wherein the cleaning means comprise a rotary brush and the actuating means comprise brush driving means, said associating means associating operation of the actuating means with operation of the shifting means in such manner that the rotation of the brush starts no sooner than when the vessel has started its displacement towards said second position.

7. A sanitary unit as claimed in claim 6, wherein said means associating operation of said actuating means with operation of said shifting means comprise programming means which comprise a rotary shaft and rotary cam discs keyed on the shaft in positions angularly offset from each other, at least two of said cam discs respectively pertaining to said actuating means and shifting means, the sanitary unit further comprising a liquid supply system for supplying liquid to the brush, the supply system comprising electrically-operated valve means and a control switch which is for controlling the valve means and is associated with to be actuatable by one of said cam discs.

8. A sanitary unit as claimed in claim 2, where the cleaning means comprise a rotary brush and the actuating means comprise a brush driving means, said associating means associating operation of the actuating means with operation of the shifting means in such manner that the rotation of the brush starts no sooner that when the two vessels parts have started their displacement toward said second positions thereof, the sanitary unit further comprising means defining an enclosure which has an opening and contains the brush, said opening being closed by the backrest and lavatory pan when the backrest and lavatory pan are in said second positions, said drain means being located in a bottom part of the enclosure and provided with a stench trap protected by a grate for filtering hard objects.

9. A sanitary unit as claimed in claim 8, wherein the cleaning means further comprise a pipe supplying water under pressure, an electrically, operated valve in said pipe and a switch for controlling the valve, said associating means causing closure of the switch upon actuation of the brush driving means.

10. A sanitary unit as claimed in claim 8, wherein the brush is mounted on two pivotal arms so as to be brought from a lower position of use to a raised position in order to give access to the filtering grate.

11. A sanitary unit as claimed in claim 8, wherein the grate is curved and includes a stepped portion which forms with the enclosure a recess for recovering the hard objects.

12. A sanitary unit comprising wall means dividing the unit into a first part for receiving a user of the unit and a second part, a water-closet receiving vessel mounted to be movable between a first position of use in said first part and a vessel emptying and cleaning second position in said second part, in which second position of the vessel is in a tipped position relative to said first position for emptying matter received by the vessel in said first position, the vessel having a closed bottom so as to be outlet-less and thereby retain matter received therein in said first position and the vessel constituting a withdrawable part of said wall means so that the vessel can pass through said wall means between said first and second positions thereof, cleaning means located in said second part for cleaning the vessel in said second position, drain means located in said second part for receiving the matter removed from the vessel, shifting means combined with the vessel for shifting the vessel between said first position and second positions, actuating means combined with the cleaning means for actuating the cleaning means, and means associating operation of the actuating means with operation of the shifting means for actuation of the cleaning means when the vessel is in said second position.

13. A sanitary unit as claimed in claim 12, comprising an enclosure containing the cleaning means and located in said second part, the enclosure defining an opening, the vessel closing said opening in said second position of the vessel, said drain means located adjacent the bottom of the enclosure for receiving matter tipped out of the vessel and removed from the vessel by the cleaning means and grate means being combined with the drain means to retain hard objects.

* * * * *